United States Patent [19]

Brown et al.

[11] 4,070,800

[45] Jan. 31, 1978

[54] CONTROL OF TORSIONAL DEFORMATION OF ELONGATE MEMBERS

[75] Inventors: Kenneth Robson Brown, Kirknewton; Andrew Guy Kerr, Edinburgh, both of Scotland

[73] Assignee: Ferranti Limited, Hollinwood, England

[21] Appl. No.: 710,748

[22] Filed: Aug. 2, 1976

[30] Foreign Application Priority Data

Aug. 2, 1975 United Kingdom ..... 32403/75

[51] Int. Cl.[2] ..... E04B 1/36

[52] U.S. Cl. ..... 52/1; 182/19; 212/144; 318/625; 318/640

[58] Field of Search ..... 212/144, 39 R, 39 MS, 212/39 A, 39 P, 39 I, 39 DB; 173/2, 43; 33/366; 182/19.2; 340/267 C; 280/700, 721; 91/390; 318/625, 689, 640; 52/1, 741; 267/154

[56] References Cited

U.S. PATENT DOCUMENTS

| | | | |
|---|---|---|---|
| 3,203,141 | 8/1965 | Musser | 52/1 |
| 3,276,024 | 9/1966 | Stevens | 52/1 X |
| 3,365,076 | 1/1968 | McManus | 212/39 R |
| 3,437,377 | 4/1969 | Lautsch | 299/1 |
| 3,707,330 | 12/1972 | Pine | 299/1 |
| 3,876,309 | 4/1975 | Zicaro et al. | 33/366 X |
| 3,971,934 | 7/1976 | Coatta | 212/39 MS |

FOREIGN PATENT DOCUMENTS

| | | | |
|---|---|---|---|
| 1,509,022 | 1/1969 | Germany | 52/1 |

*Primary Examiner*—Leslie Braun

*Attorney, Agent, or Firm*—Cameron, Kerkam, Sutton, Stowell & Stowell

[57] ABSTRACT

Apparatus for controlling deformation of an elongate member, such as a lattice girder, comprises a torque transmitting member, such as a hollow cylindrical tube, extending for the length of the girder coaxially with its longitudinal axis and fixed at one end to one end of the girder. The cylinder is free to rotate relative to the girder at its other end and is connected by hydraulic actuators to be rotated relative to the girder in response to the measurement of rotation between the ends of the girder. The relative rotation of the tube transmits torque to the fixed end and resists deformation of the girder.

13 Claims, 4 Drawing Figures

CONTROL OF TORSIONAL DEFORMATION OF ELONGATE MEMBERS

Figure 1:
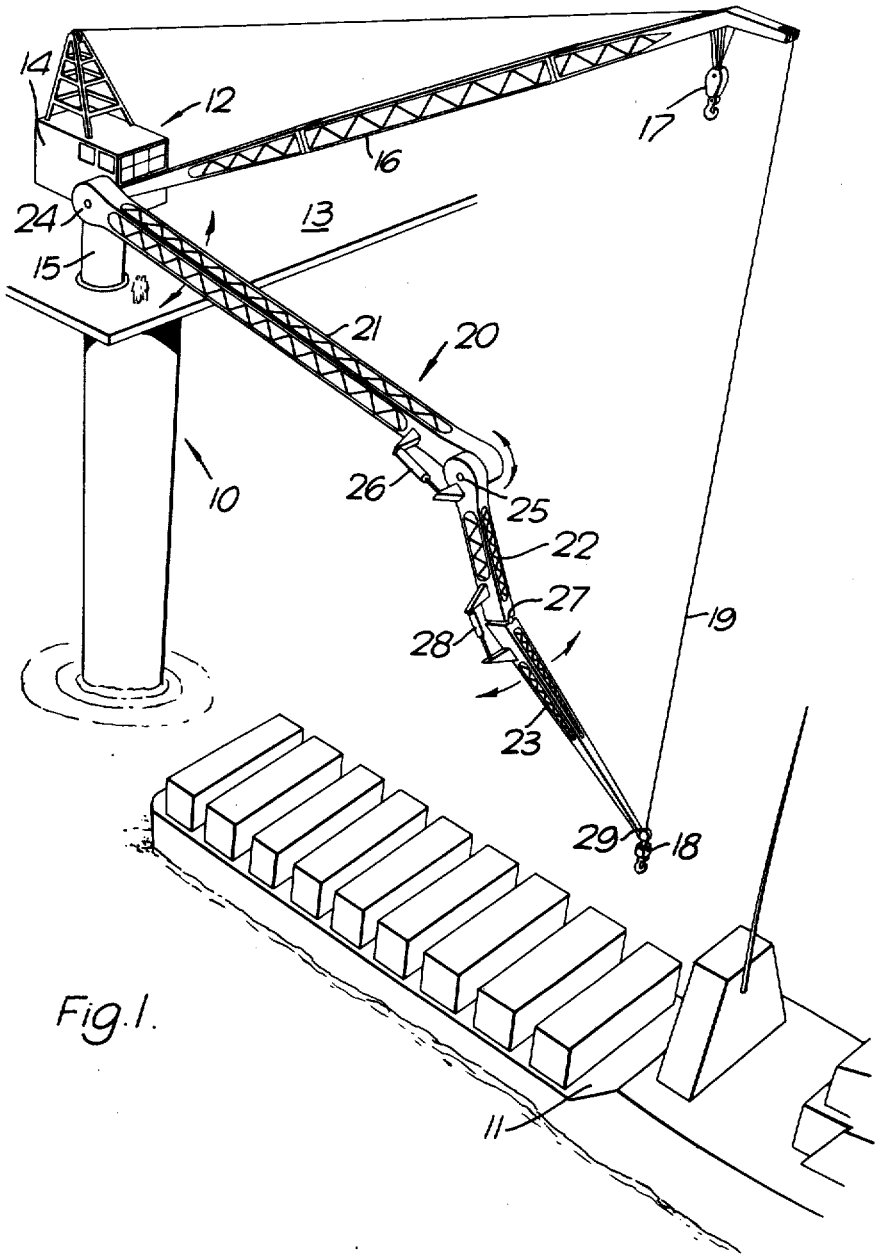

This invention relates to the control of torsional deformation of an elongate member and in particular to the control of the torsional stiffness of such a member.

Elongate members are often employed in situations for example where the members are required to undergo movement, where there is a requirement for such members to have a low inertia. Members satisfying this requirement are usually constructed to have a low mass such as may be provided by a hollow lattice girder. In a girder of this type while the mass of the materials employed in the girder is low in relation to the rigidity provided by the geometry of the construction in respect of compression, extension and of bending moments, relatively little resistance is provided against torsional deformation. Where the prevention of torsional deformation is a major factor the girder is often stiffened by the provision of extra lattice sections. Such strengthening of a member inevitably increases the mass, and therefore the inertia, of the girder by an amount which is in general related to the resistance to torsional deformation offered by the member.

It is an object of the present invention to provide apparatus for controlling the torsional stiffness of an elongate member which is arranged to cause a minimum of increase in the inertia of the member.

According to one aspect of the present invention apparatus for controlling the torsional stiffness of an elongate member comprises a torque transmitting member mounted coaxially with the longitudinal axis of the elongate member and fixed at one of its ends to the elongate member, the other end of the torque transmitting member being capable of rotation about its axis relative to the elongate member, mesuring means operable to measure torsional deformation of the elongate member to produce a control signal indicative of the sense and magnitude of the deformation, and actuating means responsive to the control signal to apply a torque to said other end of the torque transmitting member about the axis thereof in such a sense as to cause the said one end of the elongate member to be rotated relative to the other to oppose the torsional deformation.

The torque transmitting member may extend between the ends of the elongate member. The torque transmitting member may comprise a cylindrical tube contained within the elongate member.

The measuring means may comprise transducer means, having a first part fixed to the elongate member at said one end of the torque transmitting member and a second part fixed to the elongate member at said other end of the torque transmitting member, responsive to rotation between the first and second parts, to produce a transducer signal indicative of the degree of rotation and a signal processing arrangement responsive to the magnitude of the rotation measured to produce the control signal for the actuation means.

The actuating means may comprise a plurality of fluid operated piston and cylinder actuators symmetrically disposed around the periphery of the torque transmitting member, each actuator being arranged to apply pressure between the elongate member and the torque transmitting member, so as to apply forces tangentially to the torque transmitting member and cause rotation of the said one end of the torque transmitting member relative to the elongate member.

According to another aspect of the present invention a method of controlling the torsional stiffness of an elongate member comprises applying a torque to a torque transmitting member extending coaxially with the longitudinal axis of the elongate member and fixed at one end thereof to the elongate member, at a part not fixed to the elongate member to rotate the said part of the torque transmitting member relative to the elongate member and cause said one end to be rotated to oppose deformation of the elongate member.

Figure 2:
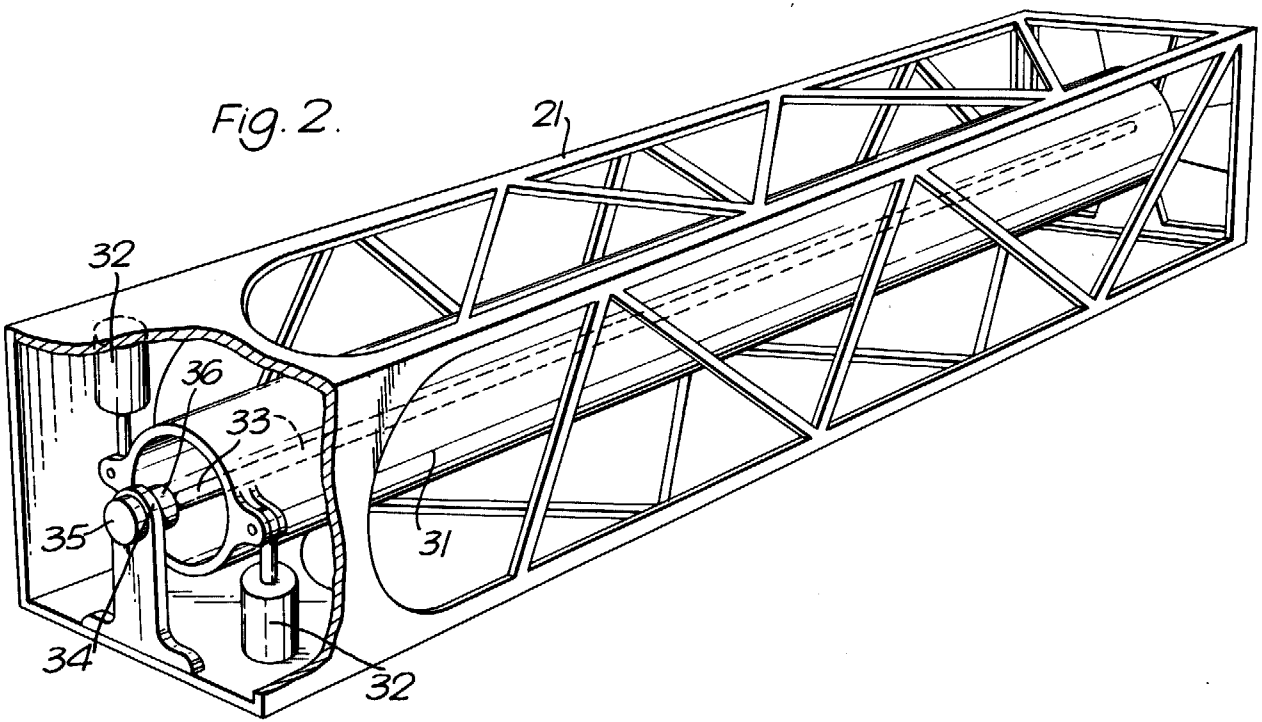
Figure 3:
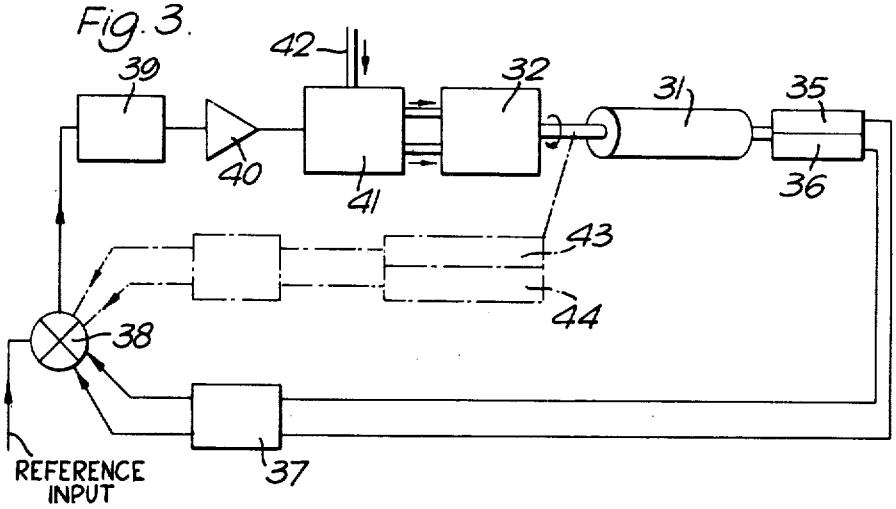
Figure 3:
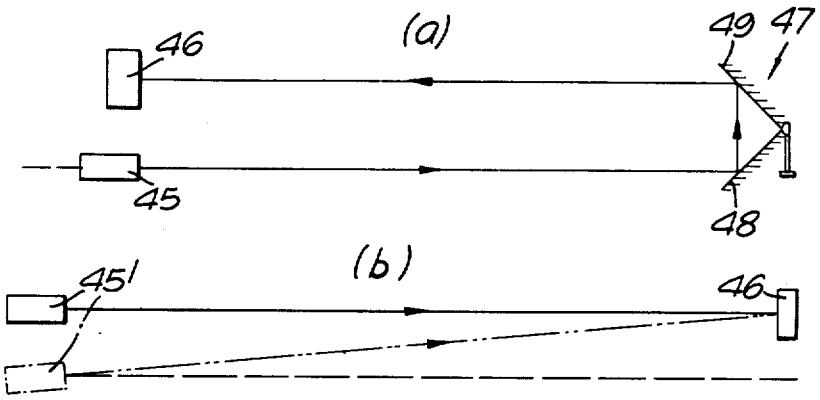
Figure 4:
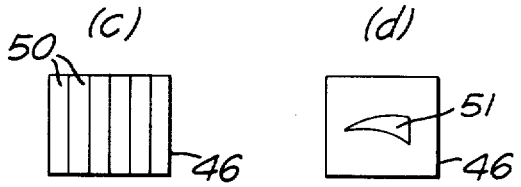

An embodiment of the invention, in use with an articulated boom of a crane hook assembly control means, will now be described by way of example with reference to the accompanying drawings, in which:

FIG. 1 is a perspective view of a crane showing an articulated boom used to control the position of the crane hook, FIG. 2 is a perspective view of a lattice girder employing torsional stiffening apparatus according to the present invention, FIG. 3 is a schematic circuit arrangement of control means for the apparatus, and FIGS. 4(*a*) to 4(*d*) show optical arrangements for measuring deformation of the girder of FIG. 2.

FIG. 1 shows a portion of an off-shore drilling platform 10 with a supply ship 11 in attendance at an unloading station. The platform carries a crane 12 on the deck 13 by which crane loads are transferred between the ship and the deck. The crane comprises a housing 14 for the winding machinery, pivotally mounted on a pedestal 15 for slewing. The housing 14 also carries a jib 16 which is pivotally mounted to allow luffing movements in a vertical plane, said jib carrying a main hoist hook assembly 17 and an auxiliary host hook assembly 18, the auxiliary host hook assembly 18 being shown in FIG. 1 suspended by a cable 19.

The crane is also provided with hook assembly control means 20 by comprising an articulated boom formed by jointed lattice girders 21, 22 and 23. The girder 21 is pivotally mounted on the crane housing at 24 and is capable of making luffing movements in a vertical plane. The girder 22 is pivotally jointed at 25 to the end of the girder 21 remote from the crane housing and is capable of movement in a vertical plane under the control of a hydraulically operated piston and cylinder actuator 26. The girder 23 is pivotally joined at 27 to the girder 22 and is capable of movement in a plane perpendicular to that of the girders 22 under the control of a piston on cylinder actuator 28. Thus by suitable luffing movements of the boom girder 21 and positioning of the girders 22 and 23 relative to it, the end 29 of the girder 23, remote from the crane, is able to maneuvre to any position within a bounded region of space. The end of the girder 23 carries releasable latching means with which to engage the hook assembly 18 so that as the hook assembly is lowered to the ship it can be guided to the desired location on the ship by movements of the control means co-ordinated with movements of the ship relative to the platform.

It will be appreciated that the end 29 of the girders 23 may be required to undertake rapid movements in response to movement of the hook assembly 18 by the cable 19 and in response to movements of the ship. It is thus desirable for the girders of the boom assembly to have as low an inertia as possible, this being provided conveniently by the use of lightweight lattice girders.

As stated above such lattice girders offer little resistance to torsional deformation but movements of the crane hook require that the girder 23 is often out of the plane of the girder 22 such that it exerts a torsional loading on the girder 21. This torsional loading is increased by the inertia of the hook assembly and any load carried by the hook assembly when it is acted upon by the girder 23.

In accordance with the present invention the girder 21, shown in FIG. 2, is provided with apparatus for controlling its torsional stiffness. The apparatus comprises a torque transmitting member in the form of a cylindrical tube 31 contained within the girder and extending for the length thereof. The cylinder is coaxial with the longitudinal axis of the girder and the two members are fixed to each other at their ends remote from the crane.

The cylinder 31 is supported in the girder by means (not shown) permitting rotation of the cylinder with respect to the girder, such rotation being cnstrained, of course, by virture of the fixing between the end of the cylinder and the girder.

Hydraulic piston and cylinder actuators 32 are carried by the girder 21 adjacent to the free end of the cylinder 31 and are coupled to the cylinder so as to supply a torque to the cylinder by way of linear tangentially acting forces.

Measuring means for the apparatus comprises transducer means having a support member in the form of a rod 33 which is fixed to the remote end of the girder with the cylinder and which extends along the axis of the girder to the free end. The rod is supported in a bracket 34 attached to the girder to permit rotation of the rod caused by torsional deformation between the ends of the girder. The rod carries, adjacent to the bracket, a displacement transducer 35 such as a synchro-machine angle resolver having a rotor coupled to the rod and a stator coupled to the bracket 34. The rod may also carry a rate transducer 36, by which the rate of rotation of the rod is measured. A further element of the measuring means, a signal processing arrangement, is shown schematicaly in FIG. 3. The hydraulic actuators 32 are connected to the cylinder 31 to cause rotation thereof in either sense in accordance with the sense of displacement of the transducers 35 and 36. The output signals of the transducers resulting from torsional deformation of the girder are taken by way of shaping and filtering circuits 37 to a signal representing the desired limit of torsional deformation between the ends of the girder; this reference signal is normally zero, representing zero deformation. An error signal produced by the mixer is passed by way of shaping and filtering circuit 39 and an amplifier 40 to an electro-hydraulic proportional control valve 41. The control valve is supplied with hydraulic power along a line 42 and controls that force exerted by the hydraulic actuators 32 on the cylinder and the torque applied thereto and the sense of the applied torque.

In operation any deformation resulting from torsional loading of the girder is indicated by the transducers 35 and 36. The hydraulic control valve 41 causes the actuators 32 to exert a force, representative of the deformation, on the cylinder 31 such that the ends fixed together of the cylinder and girder are rotated against the torsional loading to reduce the deformation. Such control can be achieved by the use only of a displacement sensor 35 but second order damping introduced by the rate sensor 36 eliminates the possibility of oscillations being set up in the girder due to hunting of the sensor control system.

It will be appreciated that a cylinder or other member capable of transmitting the torque required to control torsional deformation of the girder can, if it is torsionally resilient, be made smaller and lighter than one required not to deform under the torsional loading. Torsional resilience of the cylinder is tolerable in that any twisting of the cylinder in transmitting torque is compensated for by increasing the displacement of the free end of the cylinder until the fixed end is restored with the girder to a zero formation. In practice the resilience of the torque transmitting member increases as the length and other dimensions decrease. Thus by permitting resilience of the cylinder control of torsional deformation of the boom can be provided by the choice of suitable material for the cylinder with only a minimum increase in the weight and inertia of the girder.

An additional refinement to the measuring means is the use of secondary displacement and rate transducers 43 and 44 coupled to the free end of the cylinder as shown in FIG. 3. The secondary transducers indicate the force applied by the actuating means and the rate at which it is applied, to the cylinder as well as the result of such application on the fixed end of the cylinder. This has the advantage of simplifying the stability criteria of the control system in that the force applied to the cylinder can be varied in accordance with how close the system is to a balance point, the secondary sensors helping to eliminate the need to know accurately the response of the cylinder to torsional forces in relating the signal from the sensors 35 and 36 to the force required to be exerted by the actuator.

In the mechanical and processing arrangements shown in FIGS. 2 and 3 the hydraulic actuators operate to twist the cylinder in both senses. Instead of bidirectional actuators, additional actuators (not shown) may be employed to rotate the cylinder in each sense when directed to by the sensors 35 and 36. Where there is a requirement for the control of deformation in one sense only then unidirectional actuators and a simplified electro-hydraulic control valve may be employed.

The above described embodiments also use linear forces derived from the actuators 32 to apply a torque to the cylinder. This torque may be applied by a rotary actuator or motor (not shown) coaxial with the cylinder and may be derived from pneumatic, rather than hydraulic, pressure.

Other variations on the above described embodiments which may be employed include the elimination of the rod 33 of the control means.

Referring to FIG. 4(*a*) a light source 45 is mounted to transmit a beam of light, within or without the visible spectrum, along the longitudinal axis of the girder. A receiver 46 is mounted adjacent the source and displaced from the axis to receive light reflected by a mirror arrangement 47 attached to the opposite end of the girder. The mirror arrangement comprises two mirrors 48, 49 located at 90° to each other and 45° to the axis such that any rotation of the mirror arrangement about the axis due to torsional deformation of the girder results in the beam of light incident on the receiver moving arcuately across the surface thereof. It will be understood that the mirror arrangement 47 could be replaced by a suitable prism.

Alternatively the receiver may be mounted at the end of the girder remote from the source as shown in FIG. 4(*b*). The receiver is displaced from the axis of rotation of the girder and the source may be likewise displaced, as shown by full lines at 45′ or located on the axis as shown in chain lines at 45" to produce an obliquely directed beam. Relative rotation between the ends of the beam causes the light incident on the receiver to move over the receiver surface.

The receiver 46 in either of the arrangements described may comprise as shown in FIG. 4(*c*) a stack of individual detectors 50 arranged in strips or in an array across which the incident beam moves to define by energisation of a particular detector the extent of movement of the light beam. Alternatively as shown in FIG. 4(*d*) the receiver may comprise a single detector suitably masked apart from a slit 51 of angle related width such that the intensity of received light varies with the degree of deformation.

The torque transmitting member is shown as a hollow cylinder but in some circumstances this may be replaced by a solid axially mounted rod, in place of the rod 33, to transmit torque when suitable materials are available.

In such a case the displacement measuring means could be provided by a protective encircling tube (similar to 31) or by the photo-electric method described above or by means of an off axis pointer extending from the fixed end of the girder to measuring means adjacent the actuators 32.

Furthermore the above described method of operation has the object of reducing any torsional deformation to zero. The mixing circuit 38 (FIG. 3) may be supplied with a reference signal other than zero so that in respect of apparatus offering control in one sense the girder is permitted to undergo a predetermined amount of deformation before stiffening of the girder is introduced while in respect of control in both senses, the girder can be biased to a predetermined degree of deformation.

What we claim is:

1. Apparatus for controlling the resistance of an elongate member to torsional deformation between its ends comprising a torque transmitting member mounted coaxially with the longitudinal axis of the elongate member and rigidly fixed at one of its ends to the member in a non-rotatable manner relative to the elongate member, the other end of the torque transmitting member being capable of rotation about its axis relative to the elongate member, measuring means operable to measure torsional deformation of the elongate member to produce a control signal indicative of the sense and magnitude of the deformation, and actuating means responsive to the control signal to apply a torque to the other end of the torque transmitting member about the axis thereof in such a sense as to cause the said one end of the elongate member to be rotated relative to the other end thereof to oppose the torsional deformation.

2. Apparatus as claimed in claim 1 in which the torque transmitting member extends between the ends of the elongate member.

3. Apparatus as claimed in claim 1 in which the torque transmitting member comprises a cylindrical tube contained within the elongate member.

4. Apparatus as claimed in claim 1 in which the measuring means comprises transducer means having a first part fixed to the elongate member at said one said end of the torque transmitting member and a second part fixed to the elongate member at said other end of the torque transmitting member, the transducer means being responsive to rotation between the first and second parts to produce a transducer signal indicative of the degree of rotation and a signal processing arrangement responsive to the magnitude of the rotation measured to produce the control signal for the actuation means.

5. Apparatus as claimed in claim 4 in which the measuring means includes further transducer means operable to measure the rate of relative rotation between the ends of the elongate member.

6. Apparatus as claimed in claim 4 to which the transducer means is carried by one of the ends of the elongate member and operable to provide an electrical signal representative of the angle of relative displacement of two rotatable parts of the transducer means, one of the parts being fixed in relation to the elongate member on the longitudinal axis thereof at the end carrying the transducer, the other of the parts being carried by a support member fixed to, and extending from, the end of the elongate member remote from the transducer.

7. Apparatus as claimed in claim 6 in which the transducer means comprises a synchro-machine angle resolver.

8. Apparatus as claimed in claim 6 in which the transducer means comprises an optical shaft angle encoder.

9. Apparatus for controlling the resistance of an elongate member to torsional deformation between its ends comprising a torque transmitting member mounted coaxially with the longitudinal axis of the elongate member and fixed at one of its ends to the member, the other end of the torque transmittng member being capable of rotation about its axis relative to the elongate member, measuring means operable to measure torsional deformation of the elongate member to produce a control signal indicative of the sense and magnitude of the deformation, actuating means responsive to the control signal to apply a torque to the other end of the torque transmitting member about the axis thereof in such a sense as to cause the said one end of the elongate member to be rotated relative to the other end thereof to oppose the torsional deformation, wherein the measuring means comprises transducer means having a first part fixed to the elongate member at said one end of the torque transmitting member and a second part fixed to the elongate member at said other end of the torque transmitting member, the transducer means being responsive to rotation between the first and second parts thereof to produce a transducer signal indicative of the degree of rotation and a signal processing arrangement responsive to the magnitude of the rotation measured to produce the control signal for the actuation means, and wherein the first and second parts of the transducer means comprise a source of light and a receiver thereof located at opposite ends of the elongate member, the receiver being responsive to a beam of light received from the source and displaced from the longitudinal axis of the elongate member to provide the transducer signal.

10. Apparatus for controlling the resistance of an elongate member to torsional deformation between its ends comprising a torque transmitting member mounted coaxially with the longitudinal axis of the elongate member and fixed at one of its ends to the member, the other end of the torque transmitting member being capable of rotation about its axis relative to the elongate member, measuring means operable to measure torsional deformation of the elongate member to produce a control signal indicative of the sense and magnitude of the deformation, actuating means responsive to the control signal to apply a torque to the other end of the torque transmitting member about the axis thereof in such a sense as to cause the said one end of the elongate member to be rotated relative to the other end thereof to oppose the torsional deformation, wherein the measuring means comprises transducer means having a first part fixed to the elongate member at said one end of the torque transmitting member and a second part fixed to the elongate member at said other end of the torque transmitting member, the transducer means being responsive to rotation between the first and second parts to produce a transducer signal indicative of the degree of rotation, and a signal processing arrangement responsive to the magnitude of the rotation measured to produce the control signal for the actuation means, and wherein the first part of the measuring means comprises a source of light and a receiver thereof each located at the same end of the elongate member, the source being arranged to transmit a beam of light along the elongate member to the second part comprising a reflector at the other end of the member arranged to reflect the beam to be incident on the receiver to provide the transducer signal.

11. Apparatus for controlling the resistance of an elongate member to torsional deformation between its ends comprising a torque transmitting member mounted coaxially with the longitudinal axis of the elongate member and fixed at one of its ends to the member, the other end of the torque transmitting member being capable of rotation about its axis relative to the elongate member, measurng means operable to measure torsional deformation of the elongate member to produce a control signal indicative of the sense and magnitude of the deformation, and actuating means responsive to the control signal to apply a torque to the other end of the torque transmitting member about the axis thereof in such a sense as to cause the said one end of the elongate member to be rotated relative to the other end thereof to oppose the torsional deformation, wherein the actuating means comprises a plurality of fluid-operated piston-and-cylinder actuators symmetrically disposed about the periphery of the torque transmitting member, each actuator being arranged to apply pressure between the elongate member and the said other end of the torque transmitting member to apply forces tangentially to the torque transmitting member and cause rotation of said one end of the torque transmitting member relative to the elongate member.

12. Apparatus as claimed in claim 11 in which each actuator is arranged to apply the tangential forces in either direction of piston stroke.

13. Apparatus as claimed in claim 11 in which the signal processing arrangement comprises signal mixing means operable to compare the, or each, transducer signal with a reference signal to produce an error signal related to deviation of the transducer signal from the reference signal and an electro-hydraulic proportional control valve responsive to the error signal to provide fluid to the actuating means.

* * * * *